US006484883B1

(12) United States Patent
Edelstein

(10) Patent No.: US 6,484,883 B1
(45) Date of Patent: Nov. 26, 2002

(54) USE OF CUPRIC CHLORIDE IN ZINC FLOTATION

(75) Inventor: Philip Edelstein, Briarcliff Manor, NY (US)

(73) Assignee: Phibro-Tech Inc., Fort Lee, NJ (US)

( * ) Notice: Subject to any disclaimer, the term of this patent is extended or adjusted under 35 U.S.C. 154(b) by 0 days.

(21) Appl. No.: 09/691,837

(22) Filed: Oct. 18, 2000

(51) Int. Cl.[7] ..... B03D 1/002; B03D 1/06; B03D 1/02

(52) U.S. Cl. ..... 209/166; 209/167

(58) Field of Search ..... 209/166, 167

(56) References Cited

U.S. PATENT DOCUMENTS 1,686,529 A * 10/1928 Martin
1,727,472 A * 9/1929 Loyd
3,936,294 A * 2/1976 Childress
5,925,862 A * 7/1999 Morrisey, IV et al.

FOREIGN PATENT DOCUMENTS

SU 668708 * 6/1979

* cited by examiner

*Primary Examiner*—Thomas M. Lithgow
(74) *Attorney, Agent, or Firm*—Nixon & Vanderhye

(57) ABSTRACT

A process for activating a zinc-containing ore for flotation in aqueous media, wherein an ammonium-free aqueous cupric chloride solution is added to the media.

18 Claims, No Drawings

USE OF CUPRIC CHLORIDE IN ZINC FLOTATION

The present invention relates to the flotation recovery of zinc from zinc-containing ore. More particularly, the present invention provides a process for activation of zinc-containg ore for flotation utilizing an ammonium-free aqueous cupric chloride (spent printed wire board etchant) solution.

BACKGROUND OF THE INVENTION

Ore flotation consists of producing a mineral concentrate using chemical conditioning agents followed by intense agitation and air sparging of the agitated ore slurry to produce a mineral-rich foam concentrate. Typically, crude ore is ground to a fine powder and mixed with water and reagents. When air is blown through the mixture, mineral particles tend to cling to the bubbles, which rise to form a froth on the surface. The froth is skimmed off and the water and chemicals removed, leaving a clean concentrate. Among the minerals effectively concentrated by this method are sulfide and phosphate ores. Several stages of processing are generally involved with rough bulk flotation products being subjected to additional flotation steps to increase product purity.

U.S. Pat. No. 3,936,294 to Childress describes a method for activating zinc sphalerite mineral in which crushed zinc sphalerite is mixed with an activating solution of ammoniated aqueous $CuCO_3$ or $CuCl_2$. This activator is a substitute for $CuSO_4$ which is more expensive and less superior. Following activation, a flotation agent is added and air bubbles are introduced into the aqueous media to cause zinc to float to the surface.

The use of ammoniated aqueous $CuCO_3$ or ammoniated aqueous $CuCl_2$ is disadvantageous environmentally due to the presence of ammonia. Moreover, the use of such ammoniated copper solutions results in significant amounts of iron being extracted from the ore which carries over into the zinc.

A need exists for an improved activation solution for the flotation recovery of zinc. The present invention seeks to fill that need.

SUMMARY OF THE INVENTION

It has been discovered, surprisingly, according to the present invention, that it is possible to obtain improved zinc recovery in a zinc flotation process utilizing as activator an aqueous cupric chloride solution which is free of ammonia or ammonium compounds.

According to one aspect of the invention, there is provided a process for activation of a zinc-containing ore for flotation in aqueous media comprising adding to the media an ammonium-free aqueous cupric chloride solution.

According to another aspect, the invention provides a process for activation of zinc sphalerite for flotation in aqueous media comprising adding to the media an ammonium-free aqueous cupric chloride solution.

DETAILED DESCRIPTION OF THE INVENTION

The present invention resides in the surprising discovery that ammonium-free aqueous cupric chloride solutions, especially printed wire board spend etchant solutions, may be utilized to enhance the efficiency of flotation recovery of zinc from zinc-containing ore. A typical source of these ammonium-free aqueous cupric chloride containing solutions is spent etching solution utilized in the printed circuit board industry (printed wire board industry).

The solutions generally comprise in addition to cupric chloride (1) hydrochloric acid and chlorine gas, (2) hydrochloric acid and hydrogen peroxide, and (3) hydrochloric acid and sodium chlorate. In addition sodium chloride can be added to all three formulae. Other chemical species can be added or substituted, such as potassium chlorate. Various ratios of these chemical components are used as etchants in the printed wire board industry. Any of the weight ratios of the components in the spent etchant will work in the zinc flotation process. It will be understood that many variations in spent etchant formulas are possible, all of which will be apparent to persons of ordinary skill in the art.

As used herein, the term "ammonium-free aqueous cupric chloride solution" means an aqueous solution of cupric chloride which contains substantially no ammonia or ammonium ion, such that the pH of the solution is no greater than 6, more usually in the range of 0–3, typically no greater than 1.5. Generally, the solution contains less than 0.5% by volume ammonia or ammonium ion, more usually from zero to less than 0.005% by volume ammonia or ammonium ion.

The temperature is usually maintained in the region of 80–130° F. The control of temperature and pH is well known within the knowledge of those skilled in the art.

The flotation process of the present invention is carried out according to conventional techniques. Any zinc-containing ore may used in the process. An examples of a suitable ore is zinc sphalerite. Others known in the art are available for use. Zinc sphalerite is most typically employed in the present process.

An example of a typical step methodology will now be described for a flotation process involving an activation according to the present invention. It will be understood that many variations in mill procedure are possible, all of which will be apparent to persons of ordinary skill in this art.

Initially, the zinc ore is subjected to crushing, typically in a conventional jaw crusher. The ore is initially reduced to approximately 5 inches diameter or less, followed by further crushing to reduce the size to less than 1 inch, more usually less than ½ inch.

The ground ore is then classified according to conventional techniques. Examples of classifiers which may be employed are rake classifiers and cyclone classifiers. Differential grinding may also be employed wherein a flotation step is interposed between first and second grinding steps. A detailed discussion of differential flotation techniques along with other aspects of zinc mining is contained in AIME World Symposium on Mining and Metallurgy of LEAD and ZINC; Vol. 1, Rausch and Mariacher, eds., The American Institute of Mining, Metallurgical and Petroleum Engineers, Inc. (1970). Many other variations in the grinding and classification steps will be readily apparent to those skilled in the art.

In the majority of zinc deposits, the zinc mineral is contaminated with other elements, typically lead, copper and cadmium. Iron is also usually present. The present invention achieves effective separation of zinc from such other metals, and results in reduced carry-over of iron into the recovered zinc, as compared to prior processes utilizing copper sulfate and ammoniated cupric chloride and/or ammoniated copper carbonate.

In the next stage, following flotation of a copper-lead fraction of the mineral ore, the non-floating fraction containing the zinc-containing ore is advanced to an activation station where an ammonium-free solution of aqueous cupric chloride ($CuCl_2$) is added to the aqueous media containing the zinc ore. Examples of ammonium-free aqueous solutions of cupric chloride are provided above. The quantity of the activating solution added will vary, depending upon a number of factors. Generally, a sufficient quantity of ammonium-free solution of aqueous cupric chloride should be added to assure complete flotation of ZnS. The quantity of activating solution utilized will vary with the concentration of the solution as well as with the content of ZnS in the ore. Another factor is the amount of soluble Cu or CuO present in the mineral ore. The presence of soluble Cu or CuO will reduce the quantity of activating solution required.

In the absence of copper contamination, the amount of ammonium-free solution of cupric chloride used according to the invention may be determined using standard techniques known to those skilled in the art.

After activation of the zinc ore, and usually immediately prior to flotation, a suitable flotation agent is added to the aqueous medium. Typical flotation agents include sodium ethyl xanthate, amyl xanthate, methyl isobutyl carbinol, compounds sold under the trademark "Aerofloat" by American Cyanamid Co. and those sold under the trademark "Minerec" by Minerec Corporation.

The zinc concentrate from the flotation step is then passed to a zinc upgrading circuit where the pH is lowered and the concentrate is heated. Additional flotation agent may be added at this stage to separate pyrite from the zinc concentrate to upgrade the ore. The pyrite is returned to the zinc flotation circuit for additional reclamation. The zinc concentrate is advanced for dewatering by thickening, filtering and drying, by the use of conventional equipment. Likewise, tailings are disposed of according to techniques well known to those skilled in the art.

It has been found, surprisingly, according to the present invention that the use of ammonium-free aqueous cupric chloride results in an increased yield of zinc as compared to that obtained using ammoniated copper solutions such as copper ammonium chloride and higher than that obtained using copper sulfate. This is demonstrated below in the working Example. A further surprising and advantageous result is that the carry-over of contaminant iron from the ore to the zinc in the flotation process is less than observed using copper ammonium chloride or copper sulfate. In addition, the use of cupric chloride as opposed to ammoniated copper solutions is environmentally more advantageous, and is less costly than either ammoniated copper solutions or copper sulfate.

EXAMPLE

The invention will now be described with reference to the following working example, in which percentages and ratios are by weight.

A series of comparative tests have been performed to compare the yield of zinc obtained according to the present process utilizing ammonium-free aqueous cupric chloride with that obtained using copper sulfate and ammoniated copper chloride. The tests were carried out as standard flotations on actual mill ore (feed), using standard techniques.

The results of the tests are presented in the Tables below. In the Tables, Ore Assay—4.2% Pb 5.0% Zn 21.7% Fe, is the calculated assay of the ore (feed) prior to flotation. It is calculated by running the flotation tests and then back calculating the (head) assay of the actual ore. This is standard test procedure. "Rghr" means the Pb [Zn] rougher concentrate which is the concentrate produced by the flotation process. A material called "Clean Concentrate" is the final product produced after several post flotation steps. The term "rougher" denotes the material produced from the flotation process directly. "Tis" means "tails" or "tailings". lb Cu/T means copper per ton of ore.

% Cu in solution: 24 45

| | Copper Sulfate | | | | | | |
|---|---|---|---|---|---|---|---|
| | | Grade | | | Recovery | | |
| Product | Wt % | % Pb | % Zn | % Fe | % Pb | % Zn | % Fe |
| Ore Assay | | 3.9 | 4.8 | 21.1 | | | |
| Pb Rghr Conc | 11.4 | 31.3 | 13.4 | 22.3 | 91.4 | 31.9 | 12.1 |
| Pb Rghr TIs | 88.6 | 0.38 | 3.7 | 20.9 | 8.6 | 68.1 | 87.9 |
| Zn Rghr Conc | 6.6 | 1.9 | 45.5 | 13.9 | 3.1 | 62.7 | 4.4 |
| Zn Rghr TIs | 82.0 | 0.26 | 0.32 | 21.5 | 5.5 | 5.5 | 83.5 |
| Ib Cu/T | 0.253 | | | | | | |

% Cu in solution: 47.26

| | Copper Chloride | | | | | | |
|---|---|---|---|---|---|---|---|
| | | Grade | | | Recovery | | |
| Product | Wt % | % Pb | % Zn | % Fe | % Pb | % Zn | % Fe |
| Ore Assay | | 3.8 | 4.6 | 20.4 | | | |
| Pb Rghr Conc | 10.2 | 34.0 | 13.4 | 20.8 | 91.1 | 30.1 | 10.4 |
| Pb Rghr TIs | 89.6 | 0.38 | 3.5 | 20.4 | 8.9 | 69.9 | 89.6 |
| Zn Rghr Conc | 6.1 | 2.0 | 47.8 | 11.3 | 3.1 | 64.0 | 3.4 |
| Zn Rghr TIs | 83.7 | 0.26 | 0.32 | 21.1 | 5.6 | 5.9 | 86.3 |
| Ib Cu/T | 0.257 | | | | | | |

% Cu in solution: 31.37

| | Copper Ammonium Chloride | | | | | | |
|---|---|---|---|---|---|---|---|
| | | Grade | | | Recovery | | |
| Product | Wt % | % Pb | % Zn | % Fe | % Pb | % Zn | % Fe |
| Ore Assay | | 3.7 | 4.6 | 19.8 | | | |
| Pb Rghr Conc | 10.6 | 31.6 | 13.7 | 21.7 | 91.3 | 31.7 | 11.6 |
| Pb Rghr TIs | 89.4 | 0.36 | 3.5 | 19.6 | 8.7 | 68.3 | 88.4 |
| Zn Rghr Conc | 6.7 | 2.1 | 43.5 | 14.4 | 3.8 | 63.5 | 4.9 |
| Zn Rghr TIs | 82.7 | 0.22 | 0.27 | 20.0 | 4.9 | 4.8 | 83.6 |
| Ib Cu/T | 0.252 | | | | | | |

From the above results, it will be seen that the recovery of Zn on a percentage basis is higher (64.0%) than obtained using copper ammonium chloride (63.5%) or using copper sulfate (62.7%). Moreover, the amount of iron carry-over observed according to the present process (3.4%) is less than observed using copper ammonium chloride (4.9%) or using copper sulfate (4.4%).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for activating zinc-containing ore for, flotation in an aqueous media, comprising adding to said media an effective amount of an ammonium-free aqueous cupric chloride solution comprising hydrochloric acid and chlorine gas.

2. A process according to claim 1, wherein said ammonium-free aqueous cupric chloride solution is printed wire board spent etchant solution.

3. A process according to claim 1, wherein said ammonium-free solution of cupric chloride further comprises sodium chloride.

4. A process for activating zinc-containing ore for flotation in an aqueous media, comprising adding to said media an effective amount of an ammonium-free aqueous cupric chloride solution comprising hydrochloric acid and hydrogen peroxide.

5. A process according to claim 4, wherein said ammonium-free aqueous cupric chloride solution is printed wire board spent etchant solution.

6. A process according to claim 4, wherein said ammonium-free solution of cupric chloride further comprises sodium chloride.

7. A process for activating zinc-containing ore for fiotation in an aqueous media, comprising adding to said media an effective amount of an ammonium-free aqueous cupric chloride solution comprising hydrochloric acid and sodium chlorate.

8. A process according to claim 7, wherein said ammonium-free aqueous cupric chloride solution is printed wire board spent etchant solution.

9. A process according to claim 7, wherein said ammonium-free solution of cupric chloride further comprises sodium chloride.

10. A process according to claim 1, wherein said ore is zinc sphalerite.

11. A process according to claim 4, wherein said ore is zinc sphalerite.

12. A process according to claim 7, wherein said ore is zinc sphalerite.

13. A process of flotation of zinc sphalerite mineral ore comprising the steps of:

grinding zinc sphalerite ore in an aqueous media;

separating the ground zinc sphalerite from contaminate metal ores;

adding to said media an effective amount of an ammonium-free aqueous cupric chloride solution comprising hydrochloric acid and chlorine gas;

adding a flotation agent to said media; and introducing air into said media to cause the formation of air bubbles whereby to float said zinc sphalerite to the surface of the media.

14. A process according to claim 13, wherein said ammonium-free aqueous cupric chloride solution is printed wire board spent etchant solution.

15. A process of flotation of zinc sphalerite mineral ore comprising the steps of:

grinding zinc sphalerite ore in an aqueous media;

separating the ground zinc sphalerite from contaminate metal ores;

adding to said media an effective amount of an ammonium-free aqueous cupric chloride solution comprising hydrochloric acid and hydrogen peroxide;

adding a flotation agent to said media, and introducing air into said media to cause the formation of air bubbles whereby to float said zinc sphalerite to the surface of the media.

16. A process according to claim 15, wherein said ammonium-free aqueous cupdc chloride solution is printed wire board spent etchant solution.

17. A process of flotation of zinc sphalerite mineral ore comprising the steps of:

grinding zinc sphalerite ore in an aqueous media;

separating the ground zinc sphalerite from contaminate metal ores;

adding to said media an effective amount of an ammonium-free aqueous cupric chloride solution comprising hydrochloric acid and sodium chlorate;

adding a flotation agent to said media; and introducing air into said media to cause the formation of air bubbles whereby to float said zinc sphalerite to the surface of the media.

18. A process according to claim 17, wherein said ammonium-free aqueous cupric chloride solution is printed wire board spent etchant solution.

* * * * *